US005419352A

United States Patent [19]

Johnson

[11] Patent Number: 5,419,352

[45] Date of Patent: May 30, 1995

[54] CLEANING SYSTEM AND METHOD

[76] Inventor: Carl W. Johnson, 167 Plummer Ct., Neenah, Wis. 54956

[21] Appl. No.: 49,828

[22] Filed: Apr. 19, 1993

[51] Int. Cl.[6] ..... B08B 9/00

[52] U.S. Cl. ..... 134/102.1; 134/169 A; 134/170; 134/188

[58] Field of Search ..... 134/98.1, 95.1, 99.1, 134/105, 169 R, 169 A, 184, 188, 166 R, 170, 171, 152, 191, 111, 92, 147, 165, 102.1, 102.2, 22.18, 22.1, 34, 37

[56] References Cited

U.S. PATENT DOCUMENTS

| | | | |
|---|---|---|---|
| 2,604,895 | 7/1952 | Fechter | 134/58 |
| 4,080,975 | 3/1978 | Williams | 134/102.1 |
| 4,083,399 | 4/1978 | Babish et al. | 165/95 |
| 4,305,759 | 12/1981 | Westhoff et al. | 134/169 R |
| 4,419,141 | 12/1983 | Kunkel | 134/22.12 |
| 4,645,542 | 2/1987 | Scharton et al. | 134/1 |
| 4,867,186 | 9/1989 | Otsuka | 134/111 |
| 4,887,797 | 12/1989 | Karow | 266/49 |
| 4,923,522 | 5/1990 | Sowers | 134/22.1 |
| 4,931,400 | 6/1990 | Jitsukawa | 134/169 R |
| 4,972,805 | 11/1990 | Weems | 122/383 |
| 5,002,079 | 3/1991 | Cadwell et al. | 134/166 R |
| 5,071,487 | 12/1991 | McKibben et al. | 134/22.18 |
| 5,078,164 | 1/1992 | Dodlgast | 134/169 R |
| 5,186,760 | 2/1993 | Rubenzer | 134/169 R |
| 5,246,502 | 9/1993 | Matthews et al. | 134/169 R |

*Primary Examiner*—Frankie L. Stinson
*Attorney, Agent, or Firm*—Thomas D. Wilhelm

[57] ABSTRACT

The invention includes systems and methods of cleaning, for example, machining waste from holes in work pieces such as metal castings. The invention depends upon submerging, in a liquid, openings of the respective holes to be cleaned, aligning a nozzle with each such hole, with liquid disposed between the nozzle and the hole, and expressing one or more blasts of pressurized gas from the nozzles, through the intervening liquid, and into the holes. The apparatus contemplates a system having an array of nozzles positioned and arranged around the work piece such that a nozzle is positioned at each hole to be cleaned. The apparatus can be configured for cleaning a family of related work pieces, having differing arrangements of holes to be cleaned, by providing a nozzle for each hole included in the combination of all the arrays of all the work pieces to be cleaned.

24 Claims, 11 Drawing Sheets

CLEANING SYSTEM AND METHOD

FIELD OF THE INVENTION

This application relates to cleaning manufacturing and other foreign material from work pieces, such as cleaning machining shavings and like waste from metal castings after completion of machining operations. It especially relates to apparatus and methods for removing machining waste from metal castings and other work pieces which are machined or otherwise cut, dressed, drilled, threaded, or otherwise surfaced in manufacturing operations.

BACKGROUND OF THE INVENTION

This application is directed, in its description and illustrations, toward cleaning waste (or foreign) material from work pieces after they have been machined. It is to be understood that the same cleaning processes and apparatus could be used to remove other types of unwanted material from other types of holes, in other types of work pieces.

As used herein, the term "hole" includes such structures as conventional holes that are drilled with metal drill bits. It includes "through holes" which extend through the work piece, between two surfaces of the work piece, and thus are open on both ends. (Such holes may or may not have been made with the likes of a metal drill bit.) It includes "blind holes" which extend, from the work piece surface, into the work piece, and terminate on the interior of the work piece. It further includes cavities which existed in the casting or the like prior to the machining operation, and which are so configured as to accommodate receiving and holding of waste material generated by the machining operation.

As used herein, the term "machining" refers to milling, drilling, tapping of holes, and the like. Especially tapping operations produce holes which are difficult to clean thoroughly.

The basic application of the problem addressed by this invention is that of cleaning machining shavings and like waste from machined work pieces after the machining operations have been completed. Typically, after a casting has been machined, some of the shavings and other waste from the machining operations are lodged and/or impacted in the holes in the casting.

Because machined work pieces are typically used in assembled equipment, such as an internal combustion engine, where parts move in close relationship with each other, any waste from the machining operations which gets between the moving parts in the assembly can severely damage the assembled equipment. Thus, it is critical to remove from the machined work pieces any machining waste which would interfere with the operation of the e.g. engine. Such interference might occur in the location occupied by the waste when the machining operation is completed; or might occur if the waste is later dislodged from the work piece, whereby the waste can move around in the engine during operation of the engine. No interference is suggested where the waste occupies a position where it will not interfere with the assembly or operation of the assembled equipment, and will not be dislodged during operation of the assembled equipment.

Machining waste from machining metal castings generally comprises metal shavings of various sizes, chips or dust, and the like.

A variety of methods have been tried for cleaning machining waste from machined castings. The casting is conventionally flushed with a cutting fluid during some machining operations. This flushing does accomplish some initial but incomplete cleaning.

It is also known to subject the castings to bursts of compressed air, as described in U.S. Pat. No. 5,071,487 to McKibben et al.

It is further known to wash the work piece by submerging it in a solvent and, while the work piece is so submerged, to direct streams of solvent at holes in work piece, to try to dislodge waste material from the holes. U.S. Pat. No. 4,867,186.

While such methods do remove some, and in some cases do remove most, of the waste from the work piece, it is critical that all interfering waste material be removed. Otherwise, the high potential value of the work piece is not obtained, because the presence of the interfering waste material makes the work piece defective. In order to ensure obtaining the high potential value of the work pieces, manufacturers must, accordingly, inspect a high fraction of the work pieces in order to assure that all interfering waste material is removed from all work pieces.

A 100% inspection of all machined work pieces, for detecting and removal of machining waste, is commonly employed in some industries. Such an operation is labor intensive, and thus costly. It would be desirable to have a dependable method of cleaning machining waste from machined work pieces, such that the commitment of resources to the inspection for, and removal of, machining waste could be reduced.

It is an object of this invention to provide a cleaning system that can reliably clean foreign material from holes in work pieces such as machined castings and the like.

It is a more specific object to provide a system having such capabilities, wherein nozzles blast pressurized gas, through an intervening liquid, into the holes which need to be cleaned in such work pieces.

A related object is to provide a cleaning system that has nozzles so arranged and configured that the system can be used to clean holes in a plurality of related but different work pieces, wherein the arrays of holes in the different work pieces do differ.

Another related object related to use of the cleaning system is to provide for leveling the demand on the compressor or other source of pressurized gas.

It is another object of the invention to provide methods of cleaning holes in work pieces, by expressing blasts of gas, through a liquid medium, and into the holes.

It is a more specific object to provide a method that incorporates using a plurality of cycles, wherein each cycle includes a short period of expressing a blast of pressurized gas into the hole, followed by a period of rest wherein no pressurized gas is directed at the hole.

It is yet another object to provide a method of cleaning through holes by blasting the through hole from both ends, in sequence, so that foreign material lodged therein is urged first in one direction, then in the opposite direction.

SUMMARY OF THE DISCLOSURE

Some of the objects are attained in a cleaning system. The cleaning system generally comprises a container having a plurality of walls defining an interior chamber, the container being generally adapted to receive and hold liquid; a holder, secured to the container, in the interior chamber, the holder being adapted to hold a work piece, having a known arrangement of holes to be cleaned, in a predetermined disposition, whereby each hole is oriented in a predetermined direction, each hole having an opening, and a cross-section at the opening; an array of gas nozzles in communication with the interior chamber, each nozzle having an orifice for expressing blasts of gas therefrom, the nozzles being arranged and configured such that a nozzle is positioned outside and propinquant each hole, and is aimed toward directing a blast of gas into the respective hole, whereby the nozzles, in combination, are adapted to clean all of the holes which are to be cleaned; gas-transport lines connecting the nozzles with a source of pressurized gas, such that the gas can be delivered to the nozzles through the gas-transport lines; valving adapted to control flow of pressurized gas from its source, through the gas-transport lines, to the array of nozzles; and an exhaust opening in the container at or near the top wall, for exhausting the gas and any liquid entrained in the gas, contemporaneously with the expression of the blasts of gas from the nozzles.

In a preferred embodiment of the system, the nozzles are positioned and aimed to direct blasts of gas into each of the holes in two related but different work pieces, wherein at least one of the holes in at least one of the work pieces is in a different location than at least one hole in another work piece. Thus, the array of nozzles can be used to direct blasts into all the holes in both work pieces, where the work pieces sequentially occupy the same locus in the work station, thereby to dislodge and remove foreign material in the holes, whereby all holes to be cleaned in both work pieces can be cleaned by blasts of gas from the array of nozzles, and wherein at least one of the work pieces can be cleaned while withholding expression of gas from at least one of the nozzles.

To facilitate cleaning of the work pieces in the invention, the cross-sectional area in the nozzle orifice of a given nozzle is preferably no more than about ⅓ of the cross-sectional area of the opening at the respective hole toward which the nozzle is aimed, whereby the cross-sectional area of the gas stream, as it enters the hole, is similarly restricted to a small fraction of the cross-sectional area of the opening, such that the stream entering the hole provides only inconsequential interference with matter being expelled from the hole.

The cleaning system preferably includes an automatic controller effective to control opening and closing of the valving (i) such that no more than ⅓ of the nozzles are expressing gas at any given time, and (ii) such that each hole to be cleaned on the work piece receives two cleaning cycles, each cleaning cycle comprising a first period of no greater than 10 seconds wherein pressurized gas is expressed, as a first such blast, from the respective nozzle into the hole, followed by a second period of rest, of at least 0.5 second wherein pressurized gas is not received into the hole from any nozzle, such that each hole receives the first blast of gas, followed by a rest period, and then receives the second blast, comprising the beginning of the second cycle, whereby each hole receives at least two blasts of gas.

Where a through hole extends between first and second surfaces of the work piece, the first and second nozzles are positioned propinquant the respective ends of the hole, and the controller is preferably effective to control opening and closing of the valving so as to direct a first blast of gas into the hole at the first end and to direct a second blast of gas subsequently into the hole at the second end, whereby the hole receives the first and second blasts therein from opposing directions such that foreign material lodged in the hole is urged in a first direction by the first blast, and in a second opposing direction by the second blast.

The invention comprehends related methods of removing foreign material from a hole in a work piece, and thereby cleaning the hole, where the hole has an open end, and wherein foreign material is lodged in the hole. A first embodiment of the methods comprises the steps of immersing the work piece in a liquid to a depth sufficient to submerge the hole in the liquid; positioning a nozzle outside and propinquant the hole, the nozzle having an orifice therein for expressing gas from the nozzle; orienting the nozzle and the hole relative to each other such that the orifice is directed toward the hole, and such that liquid is disposed between the nozzle and the hole; and expressing a blast of pressurized gas, through the orifice, through the liquid, and into the hole, at the open end thereof, whereby the foreign matter is dislodged, and removed from the hole, thereby cleaning the hole.

It is preferred that the hole receive the blast for a period of no more than about 10 seconds, preferably no more than about 2 seconds, followed by a rest period of at least 0.5 second, preferably 1–4 seconds, wherein pressurized gas is not received in the hole, followed by a second blast of pressurized gas from the nozzle, through the liquid, and into the hole. In some applications, the second blast is followed by a second period of rest, like the first period of rest, and finally by a third blast of gas like the first and second blasts of gas.

Preferably, the gas is expressed from the nozzle as a stream, the stream of gas having a cross-sectional area, at the open end of the hole, no more than about ⅓ as large as the cross-sectional area of the hole at its open end.

A second embodiment of the method of the invention; is directed toward removing foreign material from a through hole having first and second opposing open ends. Here, the method comprises the steps of immersing the work piece in liquid to a depth sufficient to submerge both open ends of the hole in the liquid; positioning the first and second nozzles respectively outside and propinquant the open ends; orienting the nozzles such that the orifices are directed respectively toward the open ends; expressing a first blast of pressurized gas from the first nozzle, through the liquid, and into the hole at the first open end; and subsequently expressing a second blast of pressurized gas from the second nozzle, through the liquid, and into the hole at the second open end.

Thus, the hole receives the first and second blasts of gas therein from opposing directions. Foreign material (e.g. machining waste) lodged in the hole is urged in a first direction by the first blast, and is urged in a second opposing direction by the second blast, whereby the urging of the foreign material in opposing directions tends to increase the probability of dislodging the foreign material and removing it from the hole.

A third embodiment of the method of the invention is directed toward removing foreign material from a hole which has an opening, an elongated cross-section such that the hole has a length and corresponding first and second ends, a width shorter than the length, and a depth defining a bottom of the hole. Such holes may be cavities specified in the casting, but can still accumulate waste debris from the machining operation. Such debris must be removed. The method of cleaning such elongated holes, according to the invention, comprises the steps of immersing the work piece in liquid to a depth sufficient to submerge the opening in the liquid; positioning first and second nozzles respectively at the opening, propinquant the first and second ends of the hole; orienting the nozzles such that their orifices are directed toward the bottom of the hole; expressing a first blast of pressurized gas from the first nozzle, through the liquid, and into the hole at the first end; and subsequently expressing a second blast of pressurized gas from the second nozzle, through the liquid, and into the hole at the second end.

Preferably, the first blast is terminated before the second blast starts.

A fourth embodiment of the method of the invention addresses removing foreign material from all the holes to be cleaned in a given work piece. Here, the method comprises the steps of immersing the work piece in a liquid to a depth sufficient to submerge all the holes to be cleaned in the liquid; positioning a nozzle outside and propinquant each hole, thus defining a plurality of discrete and insular pairs of nozzles and holes, each pair comprising a hole and a nozzle outside and propinquant the hole; for each pair, positioning and orienting the nozzle and the hole relative to each other, such that the orifice in the nozzle is directed toward the hole; and expressing, from each nozzle so defined in the pairs, a blast of pressurized gas, through the liquid, and into the respective hole at its open end, whereby foreign material is dislodged and the holes are cleaned.

The method preferably includes controlling the expressing of the blasts from the several nozzles, with a plurality of valves in communication with the nozzles, such that no more than ⅓ of the nozzles are expressing gas at any given time. This helps level the demand on the pressurized gas source. The cycling described above is used as desired.

Finally, the method of the invention contemplates removing foreign material from holes to be cleaned in first and second related but different types of work pieces. The first type of work piece has at least one hole, typically a plurality of holes, comprising a first predetermined set of holes, to be cleaned. The second work piece has at least one hole, typically a plurality of holes, comprising a second predetermined set of holes, to be cleaned. At least one hole in one of the first and second sets is in a different location, or is oriented in a different direction, than at least one hole in the other of the first and second sets. The method comprises the steps of securing the first work piece in the cleaning system, which is generally as described above. The array of gas nozzles, however, is arranged and configured such that a nozzle is positioned outside and propinquant each hole whenever either a work piece of the first type, or a work piece of the second type, is held in the work piece holder.

The first work piece is immersed in liquid. The respective nozzles which are directed at the holes to be cleaned in the first work piece express blasts of gas, through the liquid, into the holes, thereby cleaning the holes in the first work piece. The first work piece is removed from the work piece holder and the second work piece is put in the same place from which the first work piece was removed. The second work piece is immersed in liquid. The respective nozzles which are directed at the holes to be cleaned in the second work piece express blasts of gas, through the liquid, and into the holes, thereby cleaning the holes in the second work piece.

Thus, work pieces of either the first or second type can be placed in the cleaning system, in any order, and all holes needing cleaning, in either work piece type, can be cleaned, even though the arrays of holes on the two types of work pieces do differ. In this embodiment of the method, the cleaning of the holes on at least one of the types of work pieces can be accomplished while withholding expression of gas from at least one of the nozzles.

DETAILED DESCRIPTION OF THE ILLUSTRATED EMBODIMENTS

Figure 1:
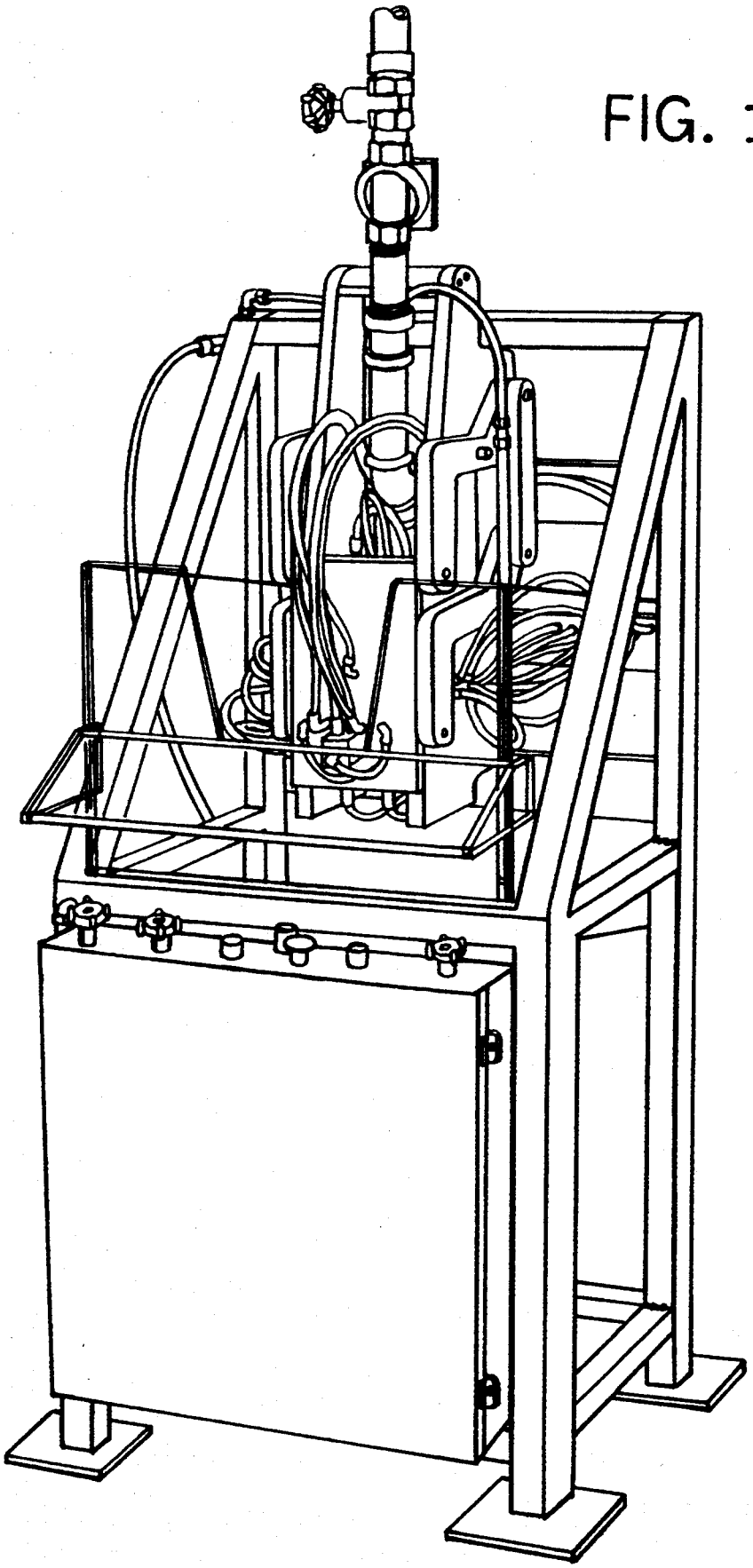
FIG. 1 is a pictorial view, angled from the front, of a cleaning system of the invention, with the access door closed.

FIGS. 1–6 illustrate the cleaning system 10 of the invention. The system 10 generally comprises a support frame 12, a cleaning container 14, liquid inlet line 16, gas nozzles 18, gas transport lines 20, valves 22, controller 24, and exhaust tray 26. The cleaning system 10 as illustrated need only be connected to typical industrial utilities, such as water, electricity, and compressed air, in order to be placed into service.

Frame 12 holds and supports the several elements of cleaning system 10.

Cleaning container 14 is generally liquid tight, such that it can contain water or other liquid for the period during which a work piece is being cleaned. Container 14 comprises a bottom wall 28, a top wall 30, two upstanding side walls 32, a rear wall 33, and an upstanding access door 34.

A plurality of nozzles 18 extend through access door 34 and into the interior chamber 36 on the inside of the container. Access door 34 is mounted to container 14 through two pairs of pivot arms 38 which pivot about two pairs of pivot shafts 40 such that the access door remains in a vertical orientation while describing an arcuate path 42 as it moves between the closed position, shown in FIG. 3, through the intermediate position shown in FIG. 4, to the full open position shown in FIG. 5. The arcuate nature of path 40 is desirable for providing clearance between nozzles 18, in access door 34, and the top wall 30 as the access door is opened and closed. Power for opening and closing access door 18 is provided to pivot arms 38 by power cylinder 44, through a bracket 46 connecting the pivot arms 38 to each other and to power cylinder 44.

Bottom wall 28 and rear wall 33, in combination, support a holder 48. Holder 48 comprises a pair of base supports 50 secured to bottom wall 28 and a "through support" 52 which is secured to rear wall 33. With the work piece 54 disposed on base supports 50 and fully engaged, as shown, by through support 52, the work piece 54 is located at the holding station 55, wherein it is engaged by the nozzles 18, and blasts of air therefrom, for cleaning.

Figure 7:
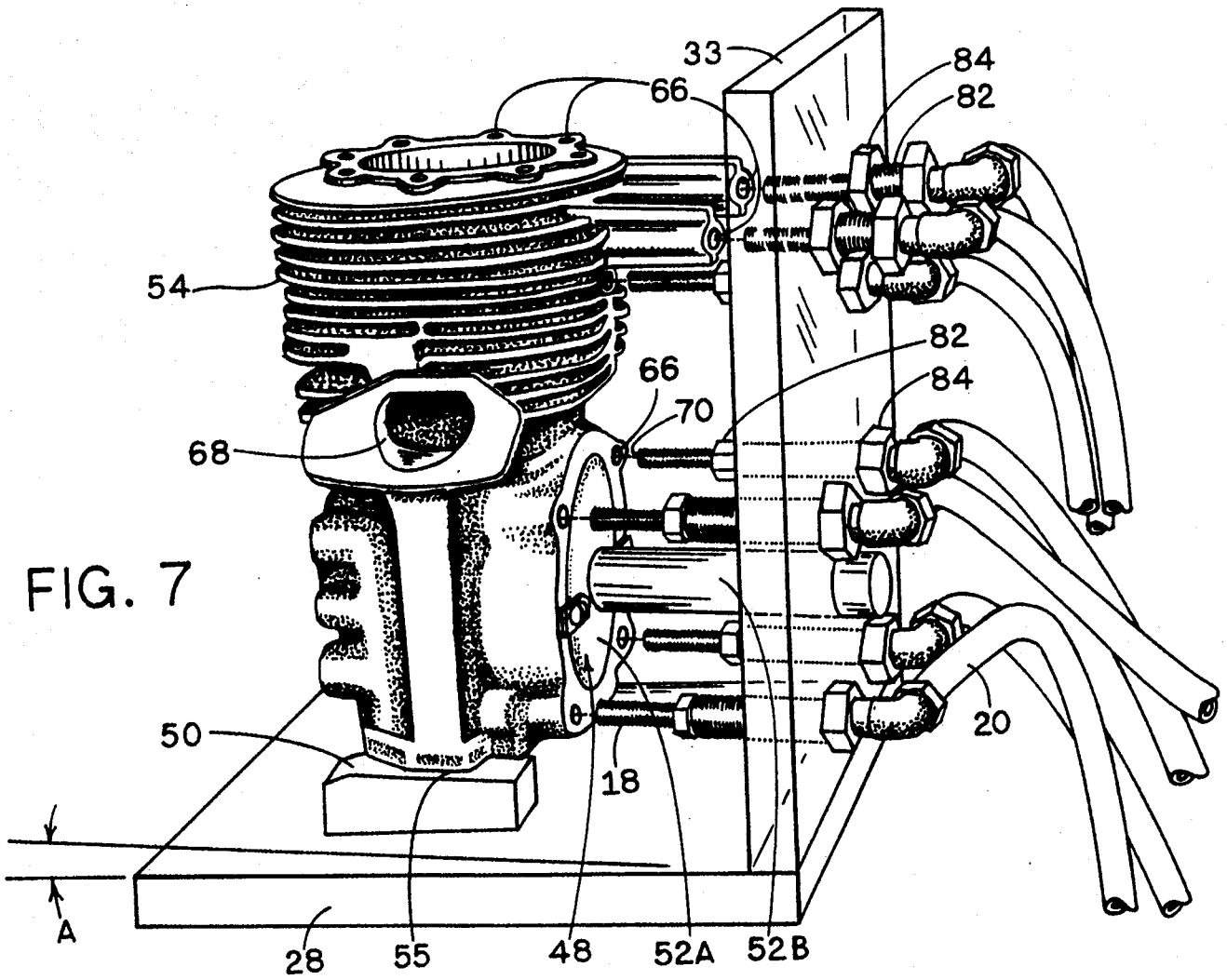
FIG. 7 is a pictorial view of a mock-up of part of the container, and a work piece, showing relationships between the container, the work piece holder, and the work piece; and between the nozzles and the holes.

The work piece 54 is supported on opposing sides under its base by a pair of the base supports 50. As the work piece is slid, from the front of the container 14, rearwardly onto base supports 50, through support 52 extends into and through the work piece. Through support 52 comprises a shaft 52B and a disc 52A, both of which engage bores on the interior of the work piece, thereby stabilizing the work piece at the holding station 55. With the work piece 54 thus supported on base supports 50, and engaged by through support 52, as shown in FIG. 7, the work piece is secured in the container 14 at the holding station 55, and is ready for beginning the cleaning process.

Liquid inlet line 16 enters the container 14 through top wall 30, and supplies water to container 14 for purposes described hereinafter.

An exhaust line 58 enters the container 14 through an exhaust opening 60 in top wall 30, and extends from top wall 30 downwardly toward exhaust tray 26. The exhaust opening 60, in combination with exhaust line 58, provides liquid and gaseous communication between the interior chamber 36 of container 14 and the ambient outside environment.

Waste liquid collects in tray 26, flows from tray 26 into funnel 62, and from funnel 62 into drain line 64.

In the embodiment shown, gas nozzles 18 are mounted to, and extend through, each of the walls 28, 30, 32, and 33, and access door 34. The number of nozzles used, and the location and orientation of each nozzle, are determined in combination with reference to the work pieces to be cleaned in the cleaning system 10.

Referring to FIG. 7, rear wall 33 is shown as being transparent in order to facilitate the illustration. The work piece 54, which represents a part of an engine, has a plurality of holes 66 which potentially contain foreign material such as shavings produced by machining operations. The holes may be e.g. dead end holes, through holes, or a large cavity such as at 68. See also the cavity illustrated in FIG. 11A. All such holes which potentially can hold machining waste or other foreign material need to be cleaned. Typical of holes which benefit from use of the cleaning system disclosed herein are holes having an average depth/diameter ratio (or equivalent) of at least 0.25/1. Holes having smaller ratio, and planar surfaces and the like typically can sometimes be cleaned by conventional cleaning systems and processes.

Holes typically cleaned using the systems and methods of the invention have depth/diameter ratios of up to about 10/1. Where cross-section of the hole is not circular, or is irregular along its length, use of an average diameter is generally adequate.

While holes having higher ratios can be cleaned, as the ratio increases, the cleaning requires more attention to the detail of the design of the specific set-up. For example nozzle design, nozzle placement, and selection of the proper air pressure become more critical.

While not limiting, a typical blind hole in a small engine block, which is cleaned using this invention, is about 0.125 to about 0.25 inch in diameter, and about 0.5 to about 1.5 inches deep.

With the work piece 54 in its secured position as shown in FIG. 7, a nozzle 18 is positioned with respect to each hole to be cleaned. The nozzles 18 extend through the respective wall 28, 30, 32, or 33, or through access door 34, as appropriate. Each nozzle is directed toward the respective hole and, in general is axially aligned with the hole as indicated in FIG. 7.

The end 70 of the nozzle 18 is located outside and propinquant the respective hole. The end 70 of the nozzle is close enough to the hole to provide a minimal distance between the end of the nozzle and the opening 72 of the hole at the surface 74 of the work piece. The end 70 is likewise displaced from the opening 72 a sufficient distance to not interfere with gas, liquid, and waste material which is expelled from the hole during the cleaning process. The most effective distance between the nozzle and the hole varies depending on a number of factors including the specifications of the hole, and specifications of the nozzle and gas pressure. A convenient such distance for initial testing of a given pair, comprising a specific hole and a specific nozzle, is about 0.25 inch.

In the embodiment shown, the work piece 54 has holes to be cleaned on its top, its bottom, its front, its rear, and its two sides. Thus nozzles extend through each of the container walls (collectively 28, 30, 32, 33, and access door 34).

Figure 6:
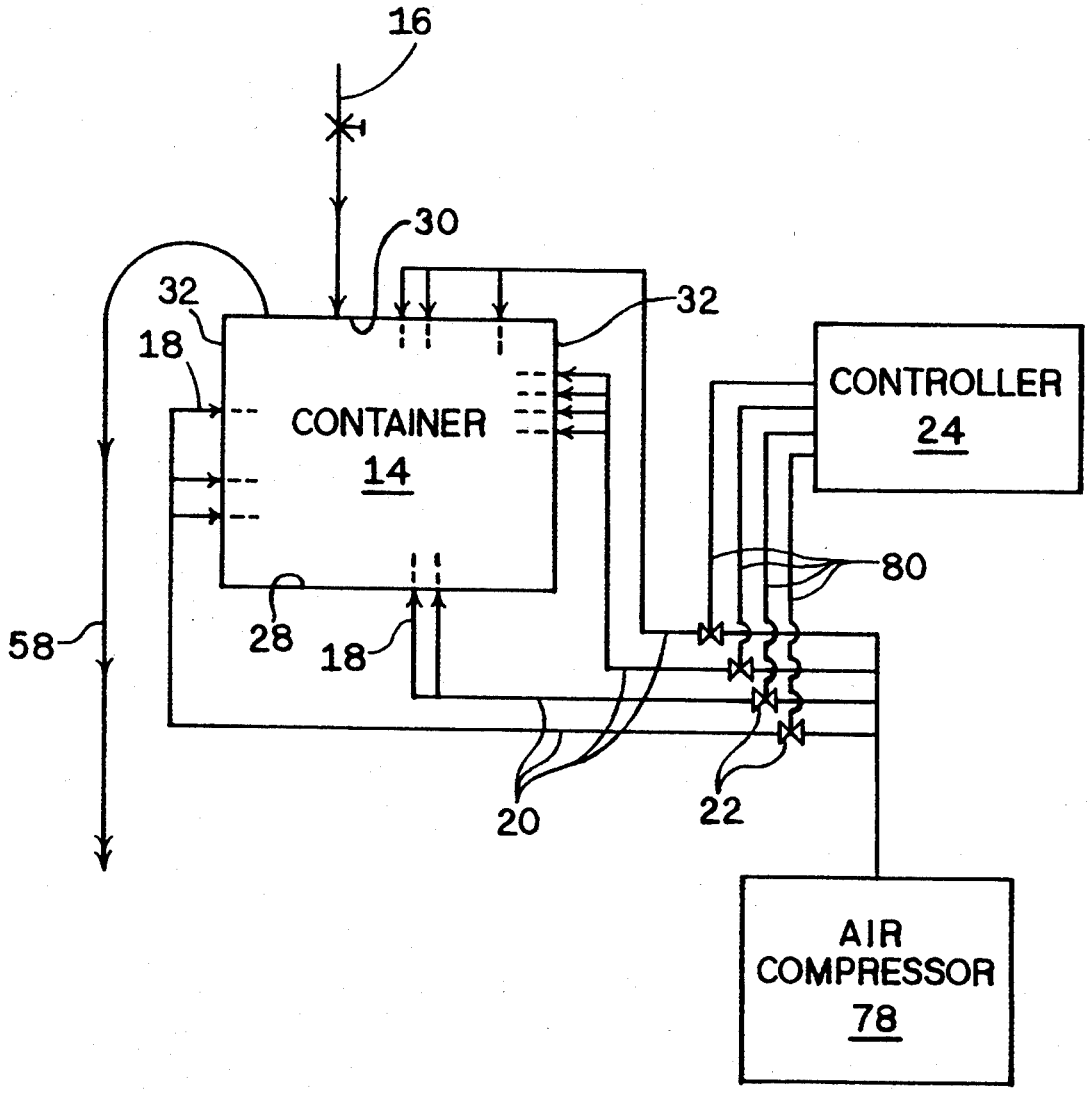
FIG. 6 is a schematic diagram, illustrating the gas flow, and valving and control of the gas lines.

Each nozzle 18 is connected by a gas transport line 20, and through a valve 22 (FIG. 6), to a source of pressurized gas, illustrated in FIG. 6 as an air compressor 78. As illustrated in FIG. 6, each valve 22 can control air flow in a plurality of transport lines 20. If preferred, each transport line 20 can be equipped with its own valve 22.

Referring to FIG. 6, only the bottom wall 28, top wall 30, and two side walls 32 are shown. Rear wall 33, and access door 34, though not shown in FIG. 6, could be similarly depicted with respect to the nozzles 18 and air lines 20, as they are shown in others of the drawings.

Valves 22 are turned on and off according to commands given in the conventional manner by controller 24, through communicating lines 80.

The work piece 54 is typically a machined metal part. The container 14 is typically made from steel plate. Nozzles 18, and the bolts 82 and nuts 84 mounting them in the container 14, are typically metal.

In the cleaning systems of the invention, with the work piece 54 secured in the position where it is to be cleaned, namely at the holding station 55, the nozzles 18 are arranged and configured such that a nozzle is positioned outside and propinquant each hole to be cleaned. Each nozzle is aimed toward directing a blast of gas, through its orifice, and through the liquid which is disposed between the nozzle and the respective hole, into the hole. Thus, the nozzles, in combination, are adapted to blast all of the holes which are to be cleaned on the respective work piece 54 during a single engagement of the cleaning system 10, and thereby to clean all such holes.

Each nozzle 18 has an orifice 86 for expressing blasts of air from the nozzle and toward a respective hole 66. The orifice represents the minimum size opening through which the air passes as it is expressed from nozzle 18. Thus the cross-section of the orifice in part determines the cross-section of the air stream as it leaves the nozzle, and as it enters the respective hole 66. In preferred embodiments of the invention, the cross-sectional area of the orifice in a given nozzle 18 is no more than ⅓ of the area of the cross-section of the respective hole, at the opening, toward which the nozzle is aimed, and preferably the cross-sectional area of the gas stream, as it enters the hole, is no more than ⅓ of the area of the cross-section of the respective hole, at the opening.

It is known to use a single machining system to process a variety of related but different work pieces. Usually such different work pieces have in common one or more mounting surfaces which can be used to mount and secure such work pieces in the machining equipment. It is desirable that the cleaning system be adapted to clean all such related but different work pieces. Holder 48 assures secure mounting of all such work pieces in container 14, for cleaning. The array of nozzles 18 is configured to include a nozzle located and positioned to treat and clean each hole of each of the work piece varieties.

For example, a first work piece has 20 holes to be cleaned. Twenty nozzles are accordingly provided in container 14 for cleaning the first work piece. A second related work piece has 21 holes to be cleaned. Of the 21 holes in the second work piece, 16 holes are in the same location, and have the same orientation, as corresponding holes in the first work piece. The remaining 5 holes have no corresponding holes on the first work piece. For treating the second work piece, 16 of the holes can be cleaned using the corresponding 16 nozzles provided for the first work piece. The other 4 nozzles provided for cleaning the first work piece are not functional for cleaning the second work piece and can be kept turned off if desired while cleaning the second work piece. In addition, 5 additional nozzles are provided in container 14 for cleaning the 5 holes in the second work piece which have no corresponding holes in the first work piece.

Thus, in order to clean both the first and second work pieces illustrated, using one cleaning system 10, 25 nozzles are provided in container 14. Sixteen of the 25 nozzles are used for cleaning both work pieces. Of the remaining 9 nozzles, 4 are functional only for use with the first work piece, and the other 5 are functional only for use with the second work piece.

In order to simplify control functions of the cleaning system, it is acceptable to express blasts of gas from all nozzles when cleaning any work piece. In that case, some nozzles express blasts in directions where there is no hole. While such blasts have no function in cleaning the work piece, neither do they do any harm.

The first and second work pieces discussed immediately above here are illustrative of first and second "types" of work pieces. Once the cleaning system is set up, with all 25 nozzles, it makes no difference, in structure of the system, whether a work piece is characterized by the first type or the second type. With either type, the system structure is equipped to clean it. If all 25 nozzles are activated each time any work piece is cleaned, then the operation of the system is insensitive to which of the two types of work piece is being cleaned. If the nozzles not needed are turned off, then a "type" command is inputted into the system when the work pieces being cleaned changes from one type to the other.

Figure 2:
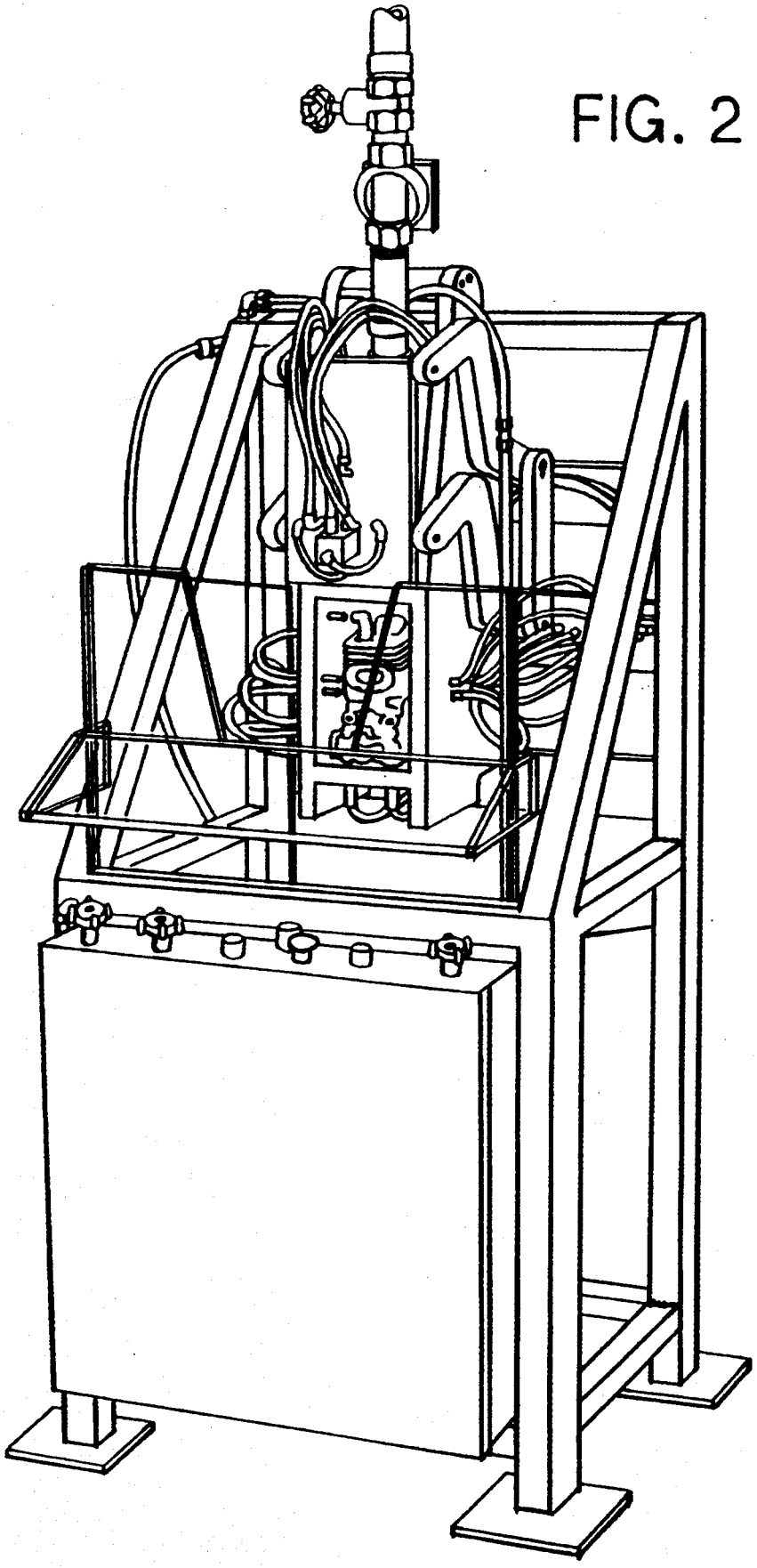
FIG. 2 is an enlarged pictorial view, shown from the same general angle as FIG. 1, showing the access door open, and a work piece inside, and showing more detail of the container, the nozzles, and the gas-transport lines.

A work piece is cleaned as follows. Starting with the access door 34 open as shown in FIG. 2, a cleaned work piece, if present, is removed from container 14 by grasping the work piece and pulling it forward from holding station 55, and out of the cleaning system. A new (dirty) work piece 54 to be cleaned, is place on the base supports 50 and pushed toward rear wall 33, thereby engaging through support 52 in the bore 88, or similar, and thereby positioning the work piece at the holding station 55.

With the work piece thus located at the holding station 55, whereat it will be cleaned, a nozzle is located outside and propinquant each hole to be cleaned. The cleaning system is activated, using the control switches on controller 24. As the system 10 starts, access door 34 closes, following the arcuate path 42 illustrated in FIGS. 3–5.

Figure 3:
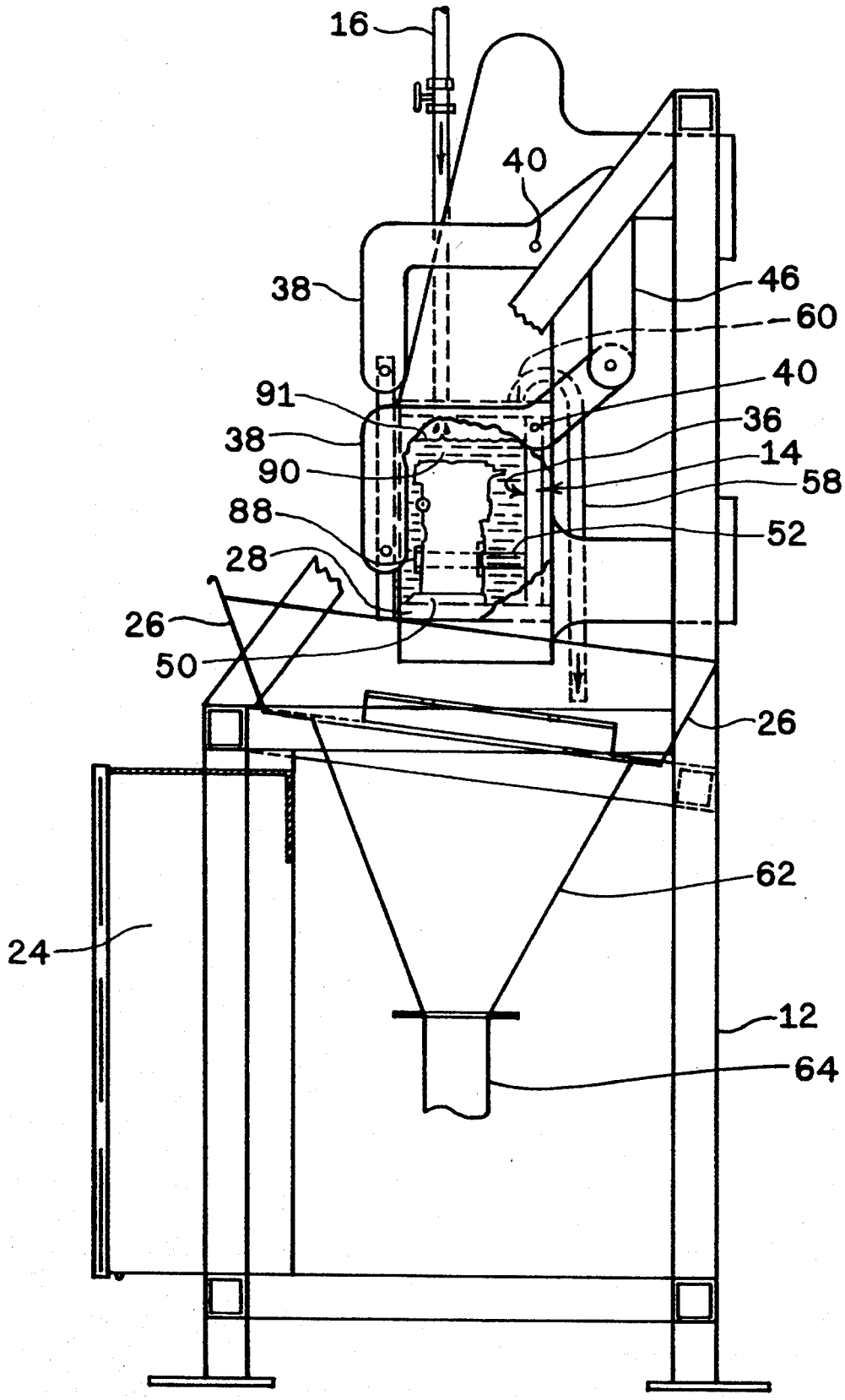
FIG. 3 is a side elevation view, with parts cut away, of the system illustrated in FIGS. 1 and 2.
Figure 5:
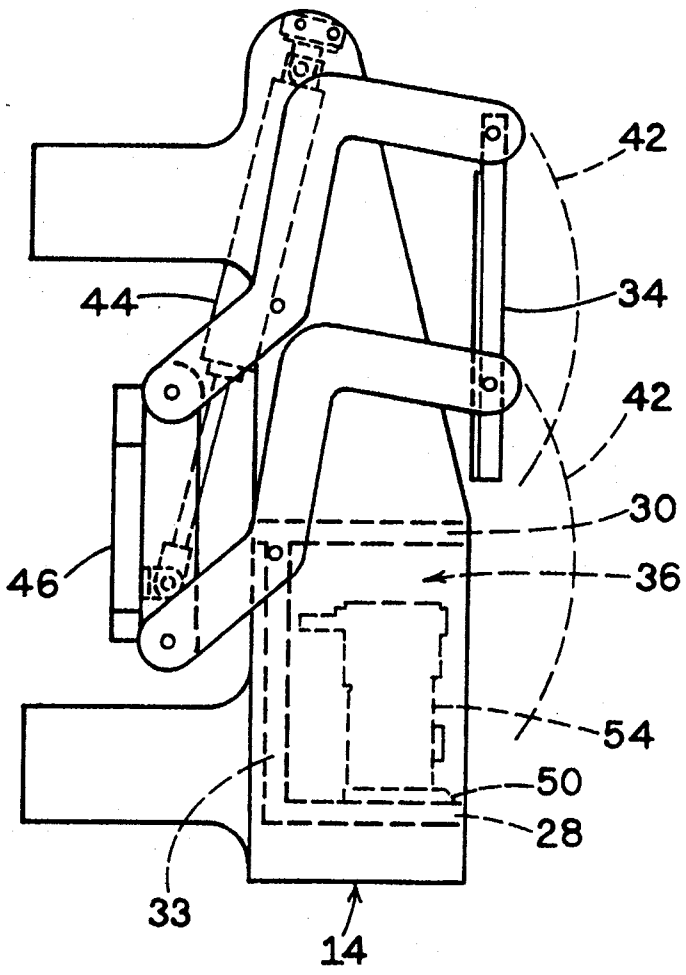
FIGS. 4 and 5 are fragmentary side elevation views, illustrating the arcuate path of travel of the access door as the door is opened and closed.
Figure 4:
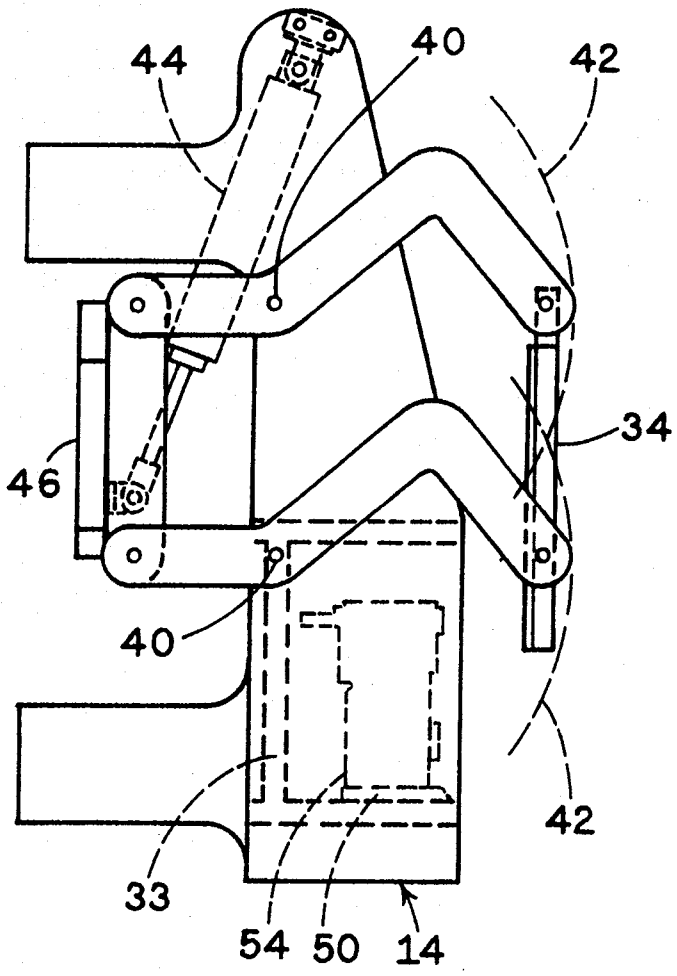

With access door 34 closed (FIG. 3), container 14 is rapidly supplied with enough water 90, through inlet line 16, to submerge all the holes 66 to be cleaned. In FIG. 3, the entire work piece is submerged below the water line 91. With the holes 66 submerged, and with the nozzles positioned adjacent the holes to be cleaned, water is located between each hole and its respective nozzle.

Controller 24 then activates valves 22 whereby blasts of compressed air are expressed from the nozzles 18, through the intervening water, and into the respective holes. Referring to a typical hole and its corresponding nozzle, as the blast of air passes through the water, the air stream is turbulent, and entrains water, carrying a combination of air and water into the hole being cleaned. In some cases, the hole will have previously been filled with water. In other cases, the hole will have previously been filled with air. In either case, the combination of air and water being expressed into the hole is effective to clean the foreign material from the hole.

Blasts of air expressed into holes through an air medium, as in McKibben U.S. Pat. No. 5,071,487, and forceful streams of liquid expressed into holes through a liquid medium, as in Otsuka U.S. Pat. No. 4,867,186, have limited effectiveness for removing lodged and/or impacted machining waste. Regardless of pressures of the air or liquid streams, or the duration of the blast, the work pieces are not reliably cleaned by these prior art methods.

By contrast, the herein disclosed expression of blasts of gas into holes through a liquid medium, are surprisingly effective at removing lodged and impacted machining waste.

In some cases, the hole is cleaned with a single blast of air. In other cases, two blasts are required, with the intervening rest period. In tests conducted by the inventor, entire work pieces, having greater than 20 holes each to be cleaned, were effectively and assuredly cleaned by a combination of 3 blasts interspersed with 2 corresponding rest periods.

Preliminary tests have shown that the majority of machining waste is removed by a single blast at 80 psig air pressure, the blast lasting 0.5–2 seconds. The single blast can be longer in duration, but there seems to be no added benefit when duration is more than 10 seconds. In most cases, the primary effect of the air blast is achieved after no more than 4–5 seconds. The blast is preferably kept as short as possible in order to conserve energy usage in compressing the gas. Thus, a blast of about 0.5–1 second is preferred.

After the blast, the nozzle is turned off for a rest period of at least 0.5 second, preferably up to 3–4 seconds. After the rest period, a second blast of air is directed toward the hole, typically at the same air pressure, and for a similar duration as the first blast of air.

In the preferred use of the cleaning system, the second blast is followed by a second rest period (as described above) and a third blast, similar to the first and second blasts. Thus, the preferred process for cleaning a hole is, in order; blast, rest, blast, rest, blast.

Using this sequencing, with 80 psig air pressure, 800 typical small engine blocks (e.g. 2 to 4 horsepower) were cleaned, and then inspected. Of the 800 work pieces, only two work pieces retained any machining waste. In each work piece where machining waste was retained, the retained waste material was so firmly lodged in a non-critical area that it would be unlikely that the waste material would be loosened during the ordinary use life of the engine. Thus, the waste material remaining was non-interfering waste, in that it would not interfere with normal use of the engine. Accordingly, when described in terms of "interfering waste," 100% of the 800 parts were cleaned and acceptable for use. Thus the invention provides 100%, or nearly 100%, reliability in cleaning machining waste from holes in machined work pieces.

In operating and cycling the nozzles, the controller times the opening and closing of the valves 22 such that fluctuations in the net air flow from the compressor are somewhat controlled. To that end, it is preferred that no more than $\frac{1}{3}$ of the nozzles be open at any given time. This is readily accomplished by using the rest period of one group of the nozzles as the blast period of a second group, and thus rotating the blast and test periods to control air flow from the compressor.

As air is blasted into the closed (liquid holding) container 14, the water 90 becomes very turbulent, whereby a mixture of air and water leaves the container 14 through exhaust opening 60 in top wall 30, and exhaust line 58, and is exhausted into exhaust tray 26. From there, the water is collected by funnel 62 and passed out of the cleaning system at drain line 64, to be cleaned and recycled. Exhaust opening 60 and exhaust line 58, and their function in exhausting air and entrained water, contemporaneously with the expressing of blasts of air from the nozzles, are critical to the integrity of the cleaning system, to prevent the build-up of excessive pressures in the container 14.

The orifice 86 in the nozzle is typically round, and is preferably about 0.030 to about 0.090 inch in diameter, preferably about 0.040 to about 0.060 inch.

Air pressure is preferably about 60 to about 100 pounds per square inch gauge. Eighty psig is preferred. The size of the nozzle orifice is changed, and the air pressure is adjusted, to accommodate such parameters as hole configuration and viscosity of the liquid used.

Water is the preferred liquid. Other liquids can be used. With liquids which are more viscous than water, both air pressure and orifice opening are typically increased.

After the work piece has been subjected to the desired number of cycles, wherein a cycle comprises a blast period followed by a rest period, all the air is turned off at valves 22, and access door 34 is opened. The water quickly drains out the front of the container 14 through the opening as the access door opens, and drops down into exhaust tray 26. The cleaned part is then removed, as before, and the next part to be cleaned is placed in the container on the holder 48.

Figure 8A:
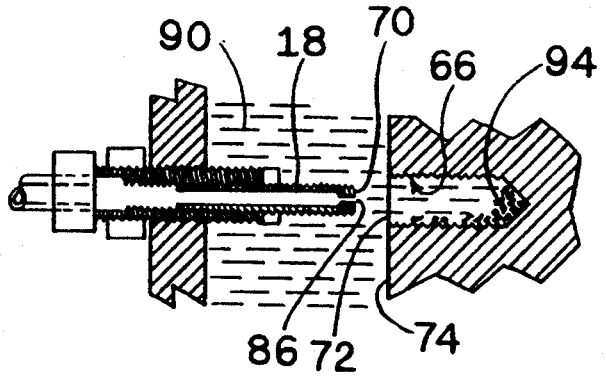
FIGS. 8A, 8B, and 8C are fragmentary views showing interaction between a nozzle and foreign material being cleaned out of a horizontally disposed drilled hole.
Figure 8B:
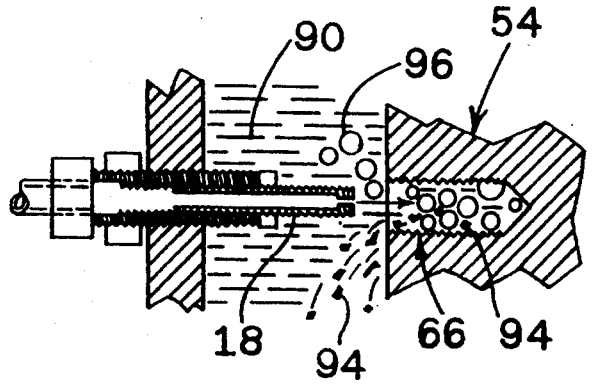
Figure 8C:
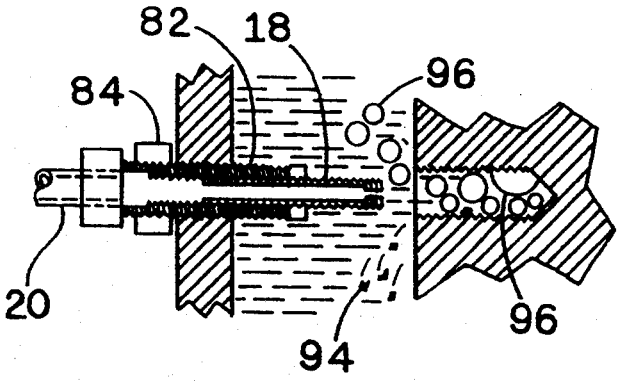

FIGS. 8A–8C illustrate the working of the air-through-water blast of the invention as best understood on a horizontally disposed dead-end hole 66. Referring to FIG. 8A, prior to any air blast, the hole 66 has particles 94 of foreign material lodged in it. The hole is also filled with water.

FIG. 8B illustrates the first blast of air in the hole 66, wherein a mixture of water 90, air bubbles 96, and particles 94 leave the hole.

FIG. 8C represents the short rest period. During at least part of the rest period, it appears that particles 94 and air bubbles 96 continue to flow out of the hole, though at a more leisurely pace. As seen in FIG. 8C, the last of the particles 94 which were removed by the blast and the subsequent rest period are falling away from the hole. some particles 94 remain in the hole. Some air bubbles 96 are still leaving the hole and are slightly enlarged. Some bubbles remain in the hole, and have become enlarged, perhaps by combining with another bubble, perhaps because of return of the environment in and around the hole to effective atmospheric pressure and quiescent conditions, perhaps a combination of the above.

The particles 94 remaining in the hole 66, in FIG. 8C, all appear to be lying loosely on the bottom surface of the hole, and thus will likely all be removed by the second blast, not shown. Thus, in the example illustrated in FIGS. 8A–8C, the hole 66 will be fully cleaned by 2 blasts from the respective nozzle 18.

Figure 9A:
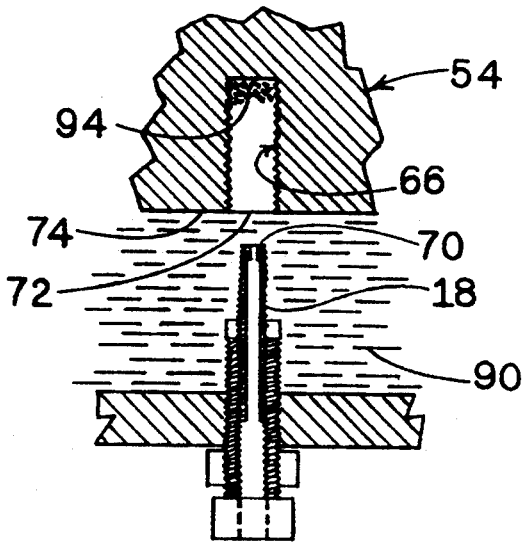
FIGS. 9A, 9B, and 9C are fragmentary views as in FIGS. 8A–8C, showing interaction between a nozzle and foreign material being cleaned out of a vertically disposed hole.
Figure 9B:
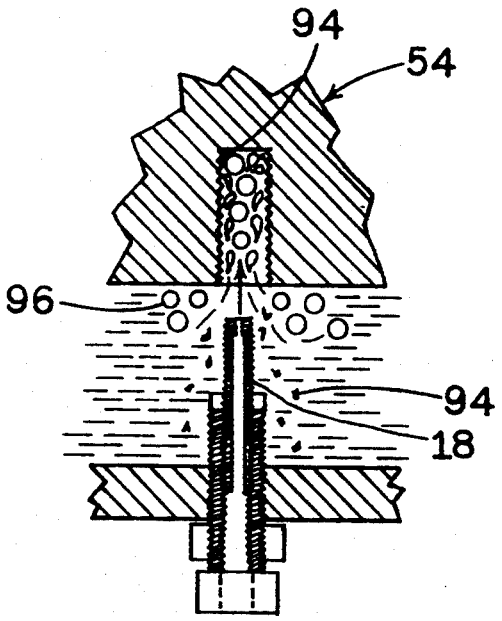
Figure 9C:
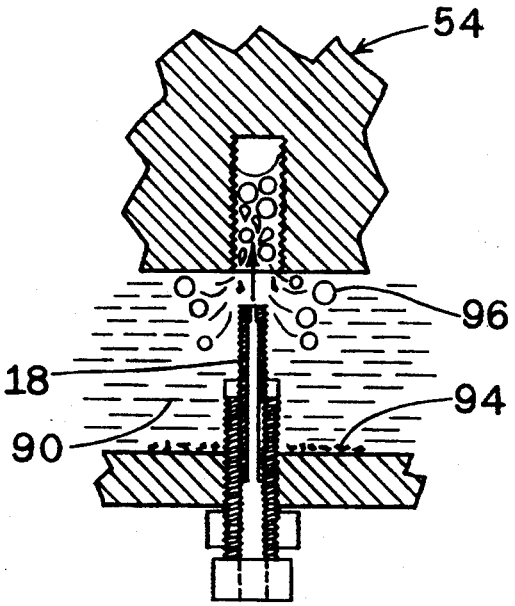

FIGS. 9A–9C illustrate the operation of the invention on a vertically disposed dead end hole. In FIG. 8A the hole is filled with water before cleaning begins. By contrast, in FIG. 9A the vertically disposed hole is filled with trapped air before cleaning begins.

FIG. 9B shows the first blast, whereby both air and water are carried into the hole, and most of the particles 94 are removed. The rest period is not shown.

FIG. 9C shows the second air blast whereby the remaining particles 94 are removed, and the hole is clean.

Figure 10A:
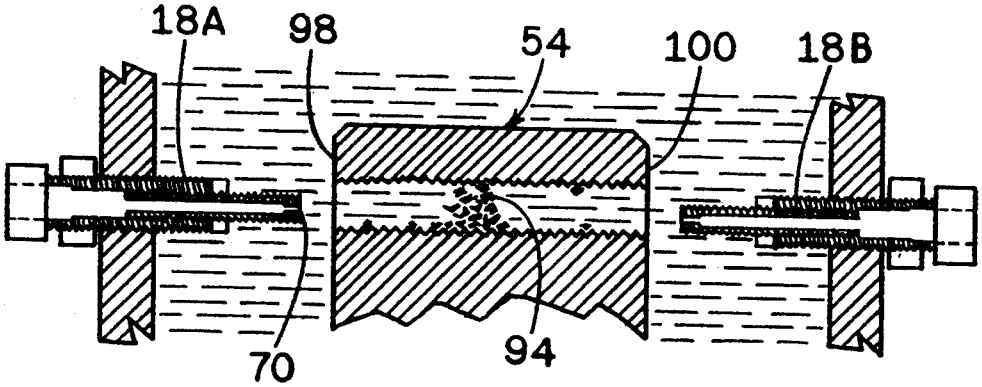
FIGS. 10A, 10B, and 10C are fragmentary views showing interaction between foreign material being cleaned out of a through hole, and nozzles at opposing ends of the through hole.
Figure 10B:
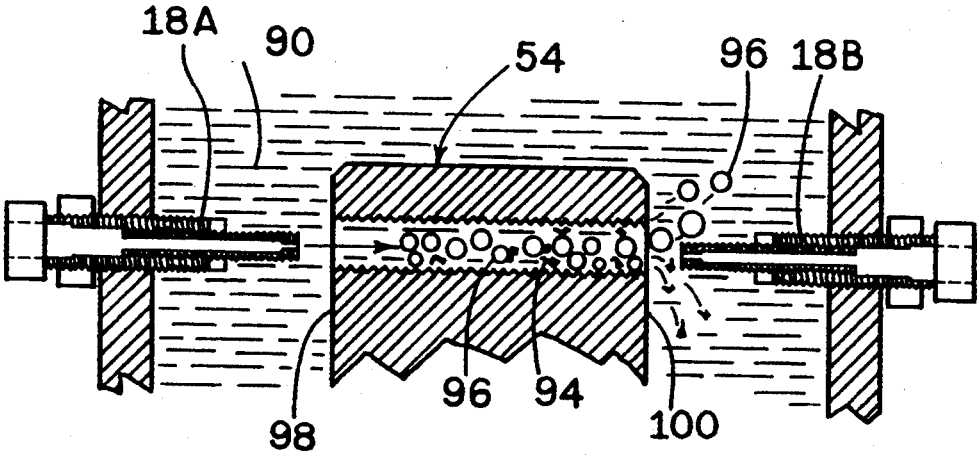
Figure 10C:
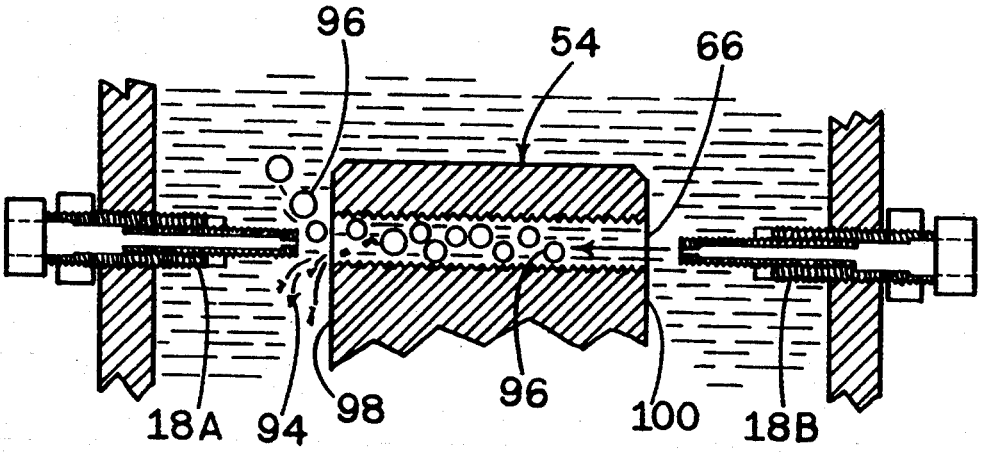

FIGS. 10A–10C illustrate operation of the invention on a through hole 66 which extends between first and second surfaces 98 and 100 of the work piece. In FIG. 10A, nozzles 18A and 18B are positioned at the respective opposing open ends of the hole. Particles 94 of foreign material are lodged in the hole.

In FIG. 10B, nozzle 18A expresses a blast of air through the hole in a first direction toward nozzle 18B and surface 100, blasting most of the particles out of the hole. Then nozzle 18B expresses a blast of air through the hole in the opposite direction toward nozzle 18A and surface 98, whereby the rest of the particles are ultimately expelled from the hole. If needed, additional blasts can be expressed, alternating directions, between nozzles 18A and 18B until the hole is clean. Thus, the particles 94 are pushed in first one direction, then in the opposite direction, as the nozzles alternate expressing blasts of air into the hole, whereby the alternating directions of pushing tend to work the particles loose, and expel them from the hole.

Figure 11A:
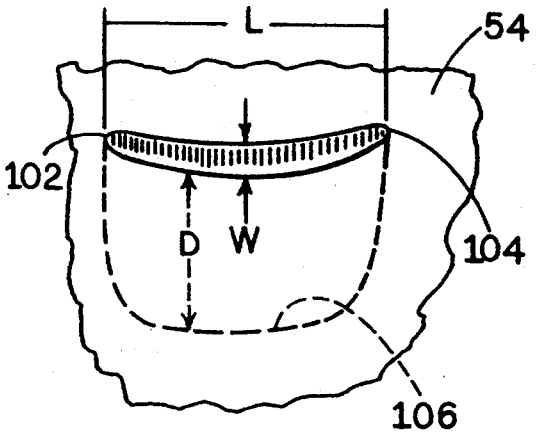
FIGS. 11A, 11B, 11C, and 11D are fragmentary views showing interaction between foreign material in an elongated cavity and a pair of nozzles cleaning the foreign material out of the cavity.
Figure 11B:
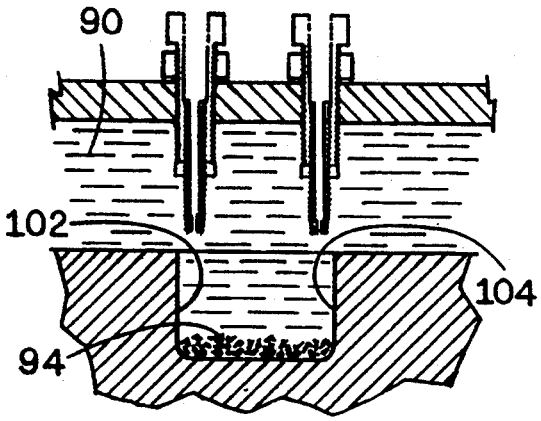
Figure 11C:
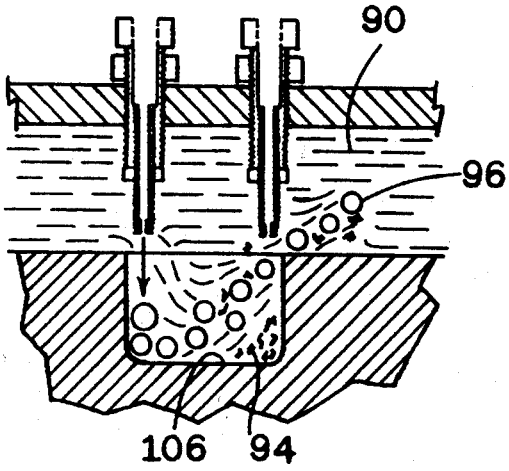

FIGS. 11A–11C illustrate an alternate method of operating the invention to clean an elongated cross section, such that the hole has a length "L" and corresponding first and second ends 102 and 104, a width "W" shorter than the length "L," and a depth "D" defining a bottom 106. Such holes are commonly encountered as cavities which are formed when the metal casting is fabricated.

FIG. 11B shows the hole in cross section, with particles 94 of foreign material at the bottom of the hole. A pair of nozzles 18A and 18B is positioned adjacent the hole at the ends 102, 104, and aimed at the bottom 106 of the hole.

Figure 11D:
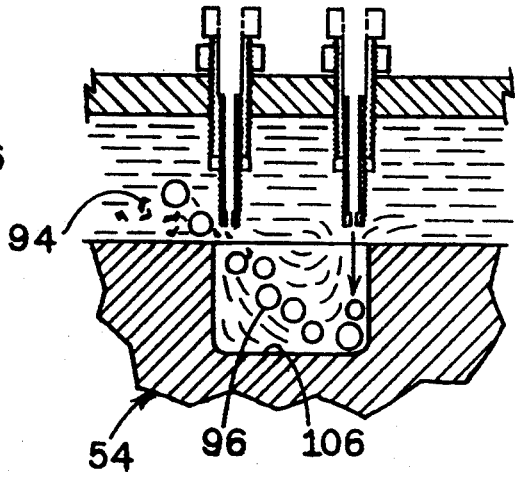
Figure 12:
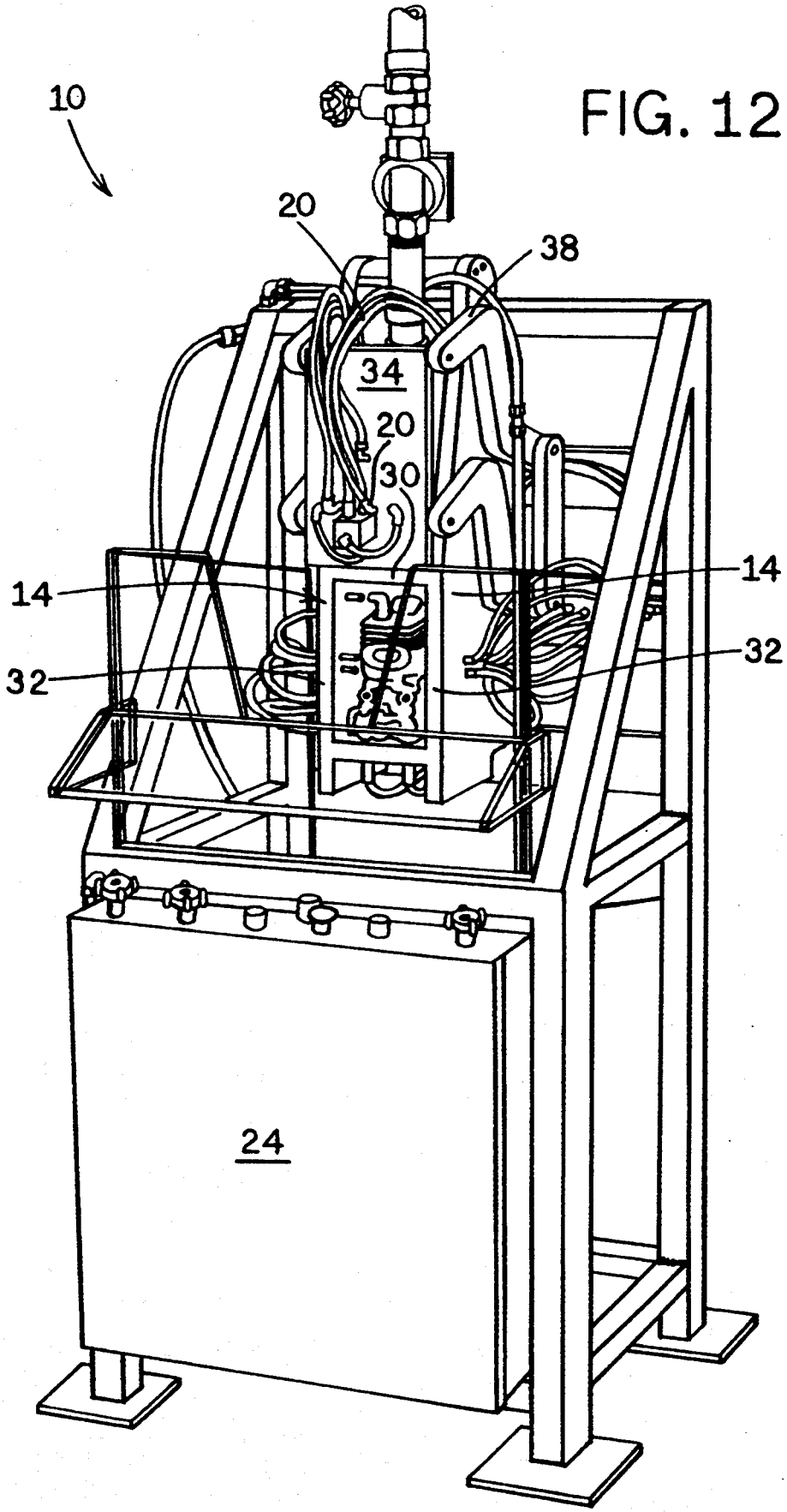
FIG. 12 is a pictorial view as in FIG. 1, with the access door open, and showing a work piece being held by the work piece holder.

As seen in FIGS. 11C AND 11D, the nozzles express blasts of air in turn, first one nozzle, then the other. This causes the particles 94 to be pushed first one direction, then in a generally opposite direction, much as the particles are pushed in opposite directions in the embodiment of the through hole shown in FIGS. 10A–10C.

The effectiveness of the multiple blasts, with intervening rest period, in cleaning work pieces that cannot be cleaned by a single blast, no matter how long, is not understood. The inventor has observed, however, that during the rest period, both particles 94 and air bubbles 96 do float out of the hole 66. Thus it is contemplated that, if the hole is not cleaned completely by the first blast, the rest period is critical to completion of the cleaning of the hole.

The cleaning system, as disclosed herein, has been illustrated as a stand alone unit, that can be moved about from place to place as needed. Thus, it can be placed at a location convenient to an existing machining operation.

The system of the invention is preferably positioned as a secondary operation, adjacent to a multiple station machining center. In such an arrangement, after the machining is completed in the machining center, the person operating the machining center removes the work piece from the machining center and places it in the cleaning system of the invention. There, the work piece is cleaned as described herein.

With only minor and obvious modification, the cleaning system of the invention can be incorporated into a multiple station machining center, with the cleaning system being one of the latter work stations of the machining center. In such an arrangement, the work piece is automatically placed at the work holding station 55 in the cleaning system after all machining operations have been completed. The work piece is held in the work holding station 55 using the same mounting surfaces as are used to mount the work piece in the other stations of the multiple station machining center. After cleaning, the work piece is removed from the machining center in a conventional manner.

The end result is that the work piece can already have been cleaned before it exits the machining center. Thus, the cleaning system of the invention can operate as part of the multiple station machining center cycle, thereby virtually eliminating the labor required to clean the work pieces after machining has been completed.

While air is preferred as the gas to be expressed from the nozzles in cleaning work pieces in the invention, other gases may be used.

In order to clean the holes in the work piece, it is not always necessary to submerge the entire work piece in the liquid. It is only necessary to immerse the work piece far enough that the hole to be cleaned is submerged, and whereby water is disposed between each hole to be cleaned and the respective nozzle. Typically, the height of the water in the container does not reach top wall 30. So long as the exhaust opening 60 is above the water line 91, the exhaust opening may be placed anywhere on or near the top wall.

Thus, when referring to the exhaust opening 60, by "on or near" the top wall, I mean that the exhaust opening must be above the controlling water line 91, which is the highest water line encountered in using that particular system on the work pieces for which it was designed.

In order to design a particular cleaning system, one must know the specifications of the work pieces which will be cleaned in it. The water line for cleaning of each such work piece will thus be known when the system is being designed. Different work pieces to be used with a given cleaning system may require different minimum heights for the water line 91. The highest such water line for a particular cleaning system 10 is used as controlling, such that exhaust opening 60 has to be above that controlling water line. Thus, specifying that the exhaust opening is above the water line, when "water line" is taken to mean the controlling water line as defined above, defines all possible locations for the exhaust opening on that particular cleaning system.

Immersing of the work piece in water or other liquid, prior to cleaning the work piece, can be done by adding liquid to a container which is holding work piece, as illustrated. Immersing the work piece can also be done by first securing the work piece to a holder, and then immersing holder and work piece, together, into a container of liquid.

As used herein "dislodging" e.g. of particles 94, means to move the particles. Such dislodged particles include particles which have been moved but which remain in the hole.

As used herein, the cross-sectional area of the gas stream comprises that gas which is traveling, from the nozzle, directly toward the hole.

Those skilled in the art will now see that certain modifications can be made to the apparatus and methods herein disclosed with respect to the illustrated embodiments, without departing from the spirit of the instant invention. And while the invention has been described above with respect to the preferred embodiments, it will be understood that the invention is adapted to numerous rearrangements, modifications, and alterations, and all such arrangements, modifications, and alterations are intended to be within the scope of the appended claims.

Having thus described the invention, what is claimed is:

1. A cleaning system, comprising:

(a) a container having a plurality of walls, including a top and a bottom, defining an interior chamber in said container, said container being generally adapted to receive and hold liquid;

(b) a holder, secured to said container, in said interior chamber, said holder having a holding station adapted to hold a work piece, having an arrangement of holes to be cleaned in said cleaning system;

(c) an array of gas nozzles in communication with said interior chamber, each said gas nozzle having an orifice for expressing blasts of gas therefrom, said array of gas nozzles being arranged such that the nozzles direct the blasts of gas into the holes in the work piece;

(d) gas-transport lines connecting said gas nozzles with a source of pressurized gas;

(e) valving adapted to control flow of pressurized gas from the source of pressurized gas, through said gas-transport lines, to said array of nozzles; and (f) an exhaust opening in said container on or near said top wall, for exhausting the gas contemporaneously with the expression of the blasts from said nozzles.

2. A cleaning system as in claim 1 and including a liquid inlet for filling said container with sufficient liquid to submerge, in the liquid, all holes in the part to be cleaned.

3. A cleaning system, comprising:

(a) a container having a plurality of walls, including a top and a bottom, defining an interior chamber in said container, said container being generally adapted to receive and hold liquid;

(b) a holder, secured to said container, in said interior chamber, said holder having a holding station adapted to hold a work piece, having an arrangement of holes to be cleaned in said cleaning system;

(c) an array of gas nozzles in communication with said interior chamber, each said gas nozzle having an orifice for expressing blasts of gas therefrom;

(d) gas-transport lines connecting said gas nozzles with source of pressurized gas;

(e) valving adapted to control flow of pressurized gas from the source of pressurized gas, through said gas-transport lines, to said array of nozzles; and (f) an exhaust opening in said container on or near said top wall, for exhausting the gas contemporaneously with the expression of the blasts from said nozzles, said cleaning system including nozzles positioned to direct blasts therefrom, into each of the holes to be cleaned in first and second related but different work pieces, the work pieces each having at least one hole to be cleaned, wherein at least one hole in the second work piece is in a different location than at least one hole in the first work piece, whereby said array of gas nozzles can be used to direct blasts into all the holes in the first work piece and subsequently to direct blasts into all the holes in the second work piece, thereby to dislodge and remove foreign material in the holes, whereby all holes to be cleaned in both of said first and second work pieces can be cleaned by blasts of gas from said array of nozzles, and wherein at least one of said first and second work pieces can be cleaned while withholding expression of gas from at least one of said nozzles.

4. A cleaning system, comprising:

(a) a container having a plurality of walls including a top and a bottom, defining an interior chamber in said container, said container being generally adapted to receive and hold liquid;

(b) a holder, secured to said container, in said interior chamber, said holder having a holding station adapted to hold a work piece, having an arrangement of holes to be cleaned in said cleaning system;

(c) an array of gas nozzles in communication with said interior chamber, each said gas nozzle having an orifice for expressing blasts of gas therefrom;

(d) gas-transport lines connecting said gas nozzles with a source of pressurized gas;

(e) valving adapted to control flow of pressurized gas from the source of pressurized gas, through said gas-transport lines, to said array of nozzles; and (f) an exhaust opening in said container on or near said top wall, for exhausting the gas contemporaneously with the expression of the blasts from said nozzles, each hole on the work piece having an opening, and a cross-section at said opening, said orifice in each said nozzle having a cross-sectional area, the area of said cross-section of an orifice in a given nozzle comprising no more than $\frac{1}{3}$ of the area of the cross-section of the respective hole, at the opening, toward which said nozzle is aimed.

5. A cleaning system, comprising:

(a) a container having a plurality of walls, including a top and a bottom, defining an interior chamber in said container, said container being generally adapted to receive and hold liquid;

(b) a holder, secured to said container, in said interior chamber, said holder having a holding station adapted to hold a work piece, having an arrangement of holes to be cleaned in said cleaning system;

(c) an array of gas nozzles in communication with said interior chamber, each said gas nozzle having an orifice for expressing blasts of gas therefrom;

(d) gas-transport lines connecting said gas nozzles with a source of pressurized gas;

(e) valving adapted to control flow of pressurized gas from the source of pressurized gas, through said gas-transport lines, to said array of nozzles;

(f) an exhaust opening in said container on or near said top wall, for exhausting the gas contemporaneously with the expression of the blasts from said nozzles; and (g) an automatic controller effective to control opening and closing of said valving.

6. A cleaning system as in claim 5, said cleaning system having, with respect to a hole having first and second open and opposing ends, a first one of said nozzles positioned at and directed toward the first open end, and a second one of said nozzles positioned at and directed toward the second open end, said controller being effective to direct a first blast into the hole at the first end and to direct a second blast subsequently into the hole at the second end, whereby the hole receives the first and second blasts of gas therein from opposing directions.

7. A cleaning system as in claim 6 and including a liquid inlet for filling said container with sufficient liquid to submerge, in the liquid, all holes in the part to be cleaned.

8. A cleaning system as in claim 5 and including a liquid inlet for filling said container with sufficient liquid to submerge, in the liquid, all holes in the part to be cleaned.

9. A cleaning system as in claim 5, said automatic controller being effective to control opening and closing of said valving such that no more than $\frac{1}{3}$ of said nozzles are expressing gas at any given time.

10. A cleaning system as in claim 5, said automatic controller being effective to control opening and closing of said valving such that each hole to be cleaned on the work piece receives two cleaning cycles, each cleaning cycle comprising a first period of no greater than 10 seconds wherein pressurized gas is expressed, as a first such blast, from the respective said nozzle into the hole, followed by a second period of rest, of at least 0.5 second wherein pressurized gas is not received into the hole from any nozzle, such that each hole receives the first blast of gas, followed by a rest period, and then receives the second blast of gas, comprising the beginning of the second cycle, whereby each hole receives at least two blasts of gas.

11. A cleaning system as in claim 10, each cleaning cycle comprising a first period of no greater than 5 seconds wherein pressurized gas in expressed, as a first such blast, from the respective said nozzle into the respective said hole.

12. A cleaning system as in claim 10, each cleaning cycle comprising a first period of no greater than 2 seconds wherein pressurized gas in expressed, as a first such blast, from the respective said nozzle into the respective said hole.

13. A cleaning system as in claim 10, each cleaning cycle comprising a first period of no greater than 1 second wherein pressurized gas in expressed, as a first such blast, from the respective said nozzle into the respective said hole.

14. A cleaning system, comprising:

(a) a container having a plurality of walls, including a top and a bottom, defining an interior chamber in said container, said container being generally adapted to receive and hold liquid;

(b) a holder, secured to said container, in said interior chamber, said holder having a holding station adapted to hold a work piece, having an arrangement of holes to be cleaned in said cleaning system;

(c) an array of gas nozzles in communication with said interior chamber, each said gas nozzle having an orifice for expressing blasts of gas therefrom, said array of gas nozzles being arranged such that the nozzles direct the blasts of gas into the holes in the work piece;

(d) gas-transport lines connecting said gas nozzles with a source of pressurized gas;

(e) valving adapted to control flow of pressurized gas from the source of pressurized gas, through said gas-transport lines, to said array of nozzles;

(f) an exhaust opening in said container on or near said top wall, for exhausting the gas contemporaneously with the expression of the blasts from said nozzles; and (g) a liquid inlet for supplying liquid in said container to submerge all holes to be cleaned.

15. A cleaning system, comprising (a) a container having a plurality of walls, including a top and a bottom, defining an interior chamber in said container, said container being generally adapted to receive and hold liquid;

(b) a holder, secured container, in said interior chamber, said holder having a holding station adapted to hold a work piece, having an arrangement of holes to be cleaned in said cleaning system;

(c) an array of gas nozzles in communication with said interior chamber, each said gas nozzle having an orifice for expressing blasts of gas therefrom;

(d) gas-transport lines connecting said gas nozzles with a source of pressurized gas;

(e) valving adapted to control flow of pressurized gas from the source of pressurized gas, through said gas-transport lines, to said array of nozzles;

(f) an exhaust opening in said container on or near said top wall, for exhausting the gas contemporaneously with the expression of the blasts from said nozzles; and (g) a liquid inlet for supplying liquid in said container to submerge all holes to be cleaned, said cleaning system including nozzles positioned to direct blasts therefrom, into each of the holes to be cleaned in first and second related but different work pieces, the work pieces each having at least one hole to be cleaned, wherein at least one hole in the second work piece is in a different location than at least one hole in the first work piece, whereby said array of gas nozzles can be used to direct blasts into all the holes in the first work piece and subsequently in the second work piece, thereby to dislodge and remove foreign material in the holes, whereby all holes to be cleaned in both of said first and second work pieces can be cleaned by blasts of gas from said array of nozzles, and wherein at least one of said first and second work pieces can be cleaned while withholding expression of gas from at least one of said nozzles.

16. A cleaning system, comprising:

(a) a container having a plurality of walls, including a top and a bottom, defining an interior chamber in said container, said container being generally adapted to receive and hold liquid;

(b) a holder, secured to said container, in said interior chamber, said holder having a holding station adapted to hold a work piece, having an arrangement of holes to be cleaned in said cleaning system;

(c) an array of gas nozzles in communication with said interior chamber, each said gas nozzle having an orifice for expressing blasts of gas therefrom;

(d) gas-transport lines connecting said gas nozzles with a source of pressurized gas;

(e) valving adapted to control flow of pressurized gas from the source of pressurized gas, through said gas-transport lines, to said array of nozzles;

(f) an exhaust opening in said container on or near said top wall, for exhausting the gas contemporaneously with the expression of the blasts from said nozzles; and (g) a liquid inlet for supplying liquid in said container to submerge all holes to be cleaned, each hole to be cleaned having an opening, and a cross-section at the opening, said orifice in each said nozzle having a cross-sectional area, the area of said cross-section of an orifice in a given nozzle comprising no more than $\frac{1}{3}$ of the area of the cross-section of the respective hole, at the opening, toward which said nozzle is aimed.

17. A cleaning system, comprising:

(a) a container having a plurality of walls, including a top and a bottom, defining an interior chamber in said container, said container being generally adapted to receive and hold liquid;

(b) a holder, secured to said container, in said interior chamber, said holder having a holding station adapted to hold a work piece, having an arrangement of holes to be cleaned in said cleaning system;

(c) an array of gas nozzles in communication with said interior chamber, each said gas nozzle having an orifice for expressing blasts of gas therefrom;

(d) gas-transport lines connecting said gas nozzles with a source of pressurized gas;
(e) valving adapted to control flow of pressurized gas from the source of pressurized gas, through said gas-transport lines, to said array of nozzles;
(f) an exhaust opening in said container on or near said top wall, for exhausting the gas contemporaneously with the expression of the blasts from said nozzles; and
(g) a liquid inlet for supplying liquid in said container to submerge all holes to be cleaned, said cleaning system including an automatic controller effective to control opening and closing of said valving such that no more than ⅓ of said nozzles are expressing gas at any given time.

18. A cleaning system as in claim 17, said automatic controller being effective to control opening and closing of said valving such that no more than ⅓ of said nozzles are expressing gas at any given time.

19. A cleaning system, comprising;
(a) a container having a plurality of walls, including a top and a bottom, defining an interior chamber in said container, said container being generally adapted to receive and hold liquid;
(b) a holder, secured to said container, in said interior chamber, said holder having a holding station adapted to hold a work piece, having an arrangement of holes to be cleaned in said cleaning system;
(c) an array of gas nozzles in communication with said interior chamber, each said gas nozzle having an orifice for expressing blasts of gas therefrom;
(d) gas-transport lines connecting said gas nozzles with a source of pressurized gas,
(e) valving adapted to control flow of pressurized gas from the source of pressurized gas, through said gas-transport lines, to said array of nozzles;
(f) an exhaust opening in said container on or near said top wall, for exhausting the gas contemporaneously with the expression of the blasts from said nozzles; and
(g) a liquid inlet for supplying liquid in said container to submerge all holes to be cleaned, said cleaning system including an automatic controller effective to control opening and closing of said valving, said cleaning system having, with respect to a hole having first and second open and opposing ends, a first one of said nozzles positioned at and directed toward the first open end, and a second one of said nozzles positioned at and directed toward the second open end, said controller being effective to direct a first blast into the hole at the first end and to direct a second blast subsequently into the hole at the second end, whereby the hole receives the first and second blasts of gas therein from opposing directions, such that foreign material lodged in the hole is urged in a first direction by the first blast, and in a second opposing direction by the second blast.

20. A cleaning system, comprising:
(a) a container having a plurality of walls, including a top and a bottom, defining an interior chamber in said container, said container being generally adapted to receive and hold liquid;
(b) a holder, secured to said container, in said interior chamber, said holder having a holding station adapted to hold a work piece, having an arrangement of holes to be cleaned in said cleaning system;
(c) an array of gas nozzles in communication with said interior chamber, each said gas nozzle having an orifice for expressing blasts of gas therefrom;
(d) gas-transport lines connecting said gas nozzles with a source of pressurized gas;
(e) valving adapted to control flow of pressurized gas from the source of pressurized gas, through said gas-transport lines, to said array of nozzles;
(f) an exhaust opening in said container on or near said top wall for exhausting the gas contemporaneously with the expression of the blasts from said nozzles; and
(g) a liquid inlet for supplying liquid in said container to submerge all holes to be cleaned, said cleaning system including an automatic controller effective to control expressions of gas from said nozzles such that each hole to be cleaned on the work piece receives two cleaning cycles, each cleaning cycle comprising a first period of no greater than 10 seconds wherein pressurized gas is expressed, as a first such blast, from the respective said nozzle into the hole, followed by a second period of rest, of at least 0.5 second wherein pressurized gas is not received into the hole from any nozzle, such that each hole receives the first blast of gas, followed by a rest period, and then receives the second blast of gas, comprising the beginning of the second cycle, whereby each hole receives at least two blasts of gas.

21. A cleaning system as in claim 20, each cleaning cycle comprising a first period of no greater than 1 second wherein pressurized gas in expressed, as a first such blast, from the respective said nozzle into the respective said hole.

22. A cleaning system, comprising:
(a) a container having a plurality of walls, including a top and a bottom, defining an interior chamber in said container, said container being generally adapted to receive and hold liquid;
(b) a holder, secured to said container, in said interior chambers, said holder having a holding station adapted to hold a work piece, having an arrangement of holes to be cleaned in said cleaning system;
(c) an array of gas nozzles in communication with said interior chamber, each said gas nozzle having an orifice for expressing blasts of gas therefrom;
(d) gas-transport lines connecting said gas nozzles with a source of pressurized gas;
(e) valving adapted to control flow of pressurized gas from the source of pressurized gas, through said gas-transport lines, to said array of nozzles; and
(f) an exhaust opening in said container on or near said top wall, for exhausting the gas contemporaneously with the expression of the blasts from said nozzles, said cleaning system having, with respect to a hole having first and second open and opposing ends, a first one of said nozzles positioned at and directed toward the first open end, and a second one of said nozzles positioned at and directed toward the second open end, said controller being effective to direct a first blast into the hole at the first end and to direct a second blast subsequently into the hole at the second end, whereby the hole receives the first and second blasts of gas therein from opposing directions.

23. A cleaning system as in claim 20, each cleaning cycle comprising a first period of no greater than 5 seconds wherein pressurized gas in expressed, as a first such blast, from the respective said nozzle into the respective said hole.

24. A cleaning system as in claim 20, each cleaning cycle comprising a first period of no greater than 2 seconds wherein pressurized gas in expressed, as a first such blast, from the respective said nozzle into the respective said hole.

* * * * *